US010902807B2

(12) United States Patent
Chen et al.

(10) Patent No.: US 10,902,807 B2
(45) Date of Patent: Jan. 26, 2021

(54) DISPLAY DEVICE AND METHOD FOR MOTION BLUR REDUCTION

(71) Applicant: Realtek Semiconductor Corporation, Hsinchu (TW)

(72) Inventors: Li-Ang Chen, Taichung (TW); Ting-Lun Hsu, Taipei (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 16/519,421

(22) Filed: Jul. 23, 2019

(65) Prior Publication Data

US 2020/0152148 A1 May 14, 2020

(30) Foreign Application Priority Data

Nov. 9, 2018 (TW) ..... 107139951 A

(51) Int. Cl.
*G09G 3/36* (2006.01)

(52) U.S. Cl.
CPC ..... *G09G 3/3648* (2013.01); *G09G 2310/08* (2013.01); *G09G 2320/0626* (2013.01); *G09G 2340/0471* (2013.01)

(58) Field of Classification Search
CPC ..... G09G 3/3648; G09G 2310/08; G09G 2320/0626; G09G 2340/0471
See application file for complete search history.

(56) References Cited

U.S. PATENT DOCUMENTS 6,507,365 B1 * 1/2003 Nakamura ..... H04N 5/2357 348/296
2004/0169631 A1 * 9/2004 Tanaka ..... G09G 5/006 345/96
2006/0158554 A1 7/2006 Cho
2008/0180385 A1 * 7/2008 Yoshida ..... G09G 3/3413 345/102
2011/0037784 A1 * 2/2011 Shiomi ..... G09G 3/3426 345/690

(Continued)

FOREIGN PATENT DOCUMENTS

CN 108269548 A 7/2018
TW 201242365 A 10/2012

OTHER PUBLICATIONS

U.S. Appl. No. 16/519,333, filed Jul. 23, 2019.

*Primary Examiner* — Ariel A Balaoing
(74) *Attorney, Agent, or Firm* — Locke Lord LLP; Tim Tingkang Xia, Esq.

(57) ABSTRACT

A display device for motion blur reduction effect is provided which includes a liquid-crystal display panel, a driving module, a backlight module and a processing module. The processing module receives input display data to generate output display data. The output display data includes an output frame data section for performing data transmission with an output pixel clock higher than an input pixel clock and an output blank section within the same frame time. The processing module drives the liquid-crystal display panel to generate a display frame according to the output display data and controls the backlight module to turn on within the output blank section after the liquid-crystal display panel finished reacting to output frame data corresponding to the output frame data section.

10 Claims, 5 Drawing Sheets

(56) References Cited

U.S. PATENT DOCUMENTS

| | | | | |
|---|---|---|---|---|
| 2013/0009857 | A1* | 1/2013 | Tchoukaleysky .... | G09G 3/3406 345/102 |
| 2018/0293942 | A1* | 10/2018 | Gu ..... | G09G 5/005 |
| 2019/0333456 | A1* | 10/2019 | Lim ..... | G09G 3/3406 |

* cited by examiner

DISPLAY DEVICE AND METHOD FOR MOTION BLUR REDUCTION

RELATED APPLICATIONS

This application claims priority to Taiwan Application Serial Number 107139951, filed Nov. 9, 2018, which is herein incorporated by reference.

BACKGROUND

Field of Invention

The present invention relates to a display technology. More particularly, the present invention relates to a display device and a method for motion blur reduction.

Description of Related Art

Common liquid crystal display device are implemented by a hold-type display technology, in which, for example, the display frame is refreshed every 16.67 millisecond to accomplish 60 times of refreshing per second. Before being refreshed, the frame being displayed is still. However, when the observer's eyes track the object in the frame, a position of the object is anticipated according to the moving speed of the object. Nevertheless, due to the discontinuity of the refresh time of the liquid crystal display device, the actual position of the object is different from the position of the object anticipated by the brain of the observer. The positions of the object being tracked in the frames corresponding to different time spots are integrated due to the visual persistence and the motion compensation mechanism of the human eyes. Such a mechanism results in motion blur.

Accordingly, what is needed is a display device and a method for motion blur reduction to address the issues mentioned above.

SUMMARY

An aspect of the present invention is to provide a display device for motion blur reduction which includes a liquid-crystal display panel, a driving module, a backlight module and a processing module. The driving module is electrically coupled to the liquid-crystal display panel. The backlight module is configured to generate a backlight to the liquid-crystal display panel. The processing module is electrically coupled to the backlight module and the driving module and configured to receive input display data, wherein the input display data corresponds to a frame time between two neighboring input vertical sync signals (Vsync) and the frame time comprises an input frame data section for performing data transmission according to an input pixel clock and an input blank section after the input frame data section. The processing module is configured to generate output display data according to the input display data such that within the frame time having the same length, the output display data comprises an output frame data section for performing data transmission with an output pixel clock higher than the input pixel clock and a dummy output frame data section after the output frame data section, and the processing module is configured to drive the liquid-crystal display panel through the driving module to generate a display frame according to the output display data. The processing module is further configured to turn on the backlight module within the dummy output frame data section after the liquid-crystal display panel finished reacting to output frame data corresponding to the output frame data section.

Another aspect of the present invention is to provide a display method for motion blur reduction used in a display device which comprises a liquid crystal display panel, a driving module electrically coupled to the liquid-crystal display panel, a backlight module configured to generate a backlight to the liquid-crystal display panel and a processing module electrically coupled to the backlight module and the driving module. The display method includes the steps outlined below. Input display data is received by the processing module, wherein the input display data corresponds to a frame time between two neighboring input vertical sync signals (Vsync) and the frame time comprises an input frame data section for performing data transmission according to an input pixel clock and an input blank section after the input frame data section. Output display data is generated according to the input display data by the processing module such that within the frame time having the same length, the output display data comprises an output frame data section for performing data transmission with an output pixel clock higher than the input pixel clock and a dummy output frame data section after the output frame data section. The liquid-crystal display panel is driven through the driving module by the processing module to generate a display frame according to the output display data. The backlight module is turned on by the processing module within the dummy output frame data section after the liquid-crystal display panel finished reacting to output frame data corresponding to the output frame data section.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
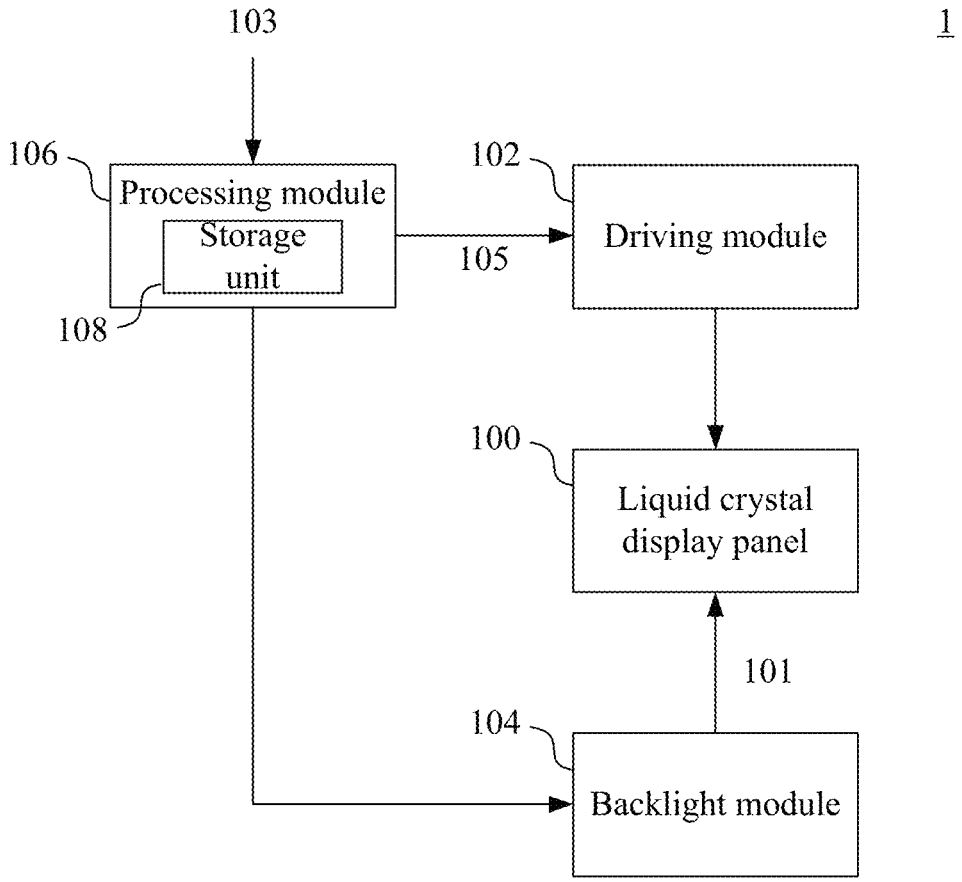
FIG. 1 is a block diagram of a display device for motion blur reduction in an embodiment of the present invention.

Reference is now made to FIG. 1. FIG. 1 is a block diagram of a display device 1 for motion blur reduction in an embodiment of the present invention. The display device 1 includes a liquid-crystal display panel 100, a driving module 102, a backlight module 104 and a processing module 106.

In an embodiment, the liquid-crystal display panel 100 includes a plurality of display units (not illustrated) arranged as an array.

The driving module 102 is electrically coupled to the liquid-crystal display panel 100. In an embodiment, the driving module 102 includes a gate driver and a source driver (not illustrated). The gate driver is coupled to gates of transistors of a row of the display units of the liquid-crystal display panel 100 and is responsible of turning on and off each row of the transistors. The row of the transistors is turned on during a scanning process. When the transistors are turned on, the source driver transmits the control voltage that controls the brightness, the gray level and the color column by column through a tunnel formed by the source and the drain of each of the transistors to the pixels of the display units.

The backlight module 104 is configured to generate a backlight 101 to the liquid-crystal display panel 100 to light up the liquid-crystal display panel 100 such that the user can watch the display frame displayed by the liquid-crystal display panel 100.

In an embodiment, the processing module 106 is a scaler or a timing controller. However, the present invention is not limited thereto. The processing module 106 is electrically coupled to the backlight module 104 and the driving module 102 and is configured to receive input display data 103 and generate output display data 105 according to the input display data 103. Based on the output display data 105, the processing module 106 drives the liquid-crystal display panel 100 through the driving module 102 to generate display frames. Further, along with the generation of the output display data 105, the processing module 106 controls the backlight module 104 to generate the backlight 101 to light up the liquid-crystal display panel 100 such that the display frames can be watched by the user.

The mechanism of the generation of the output display data 105 and the mechanism of the control of the backlight module 104 performed by the processing module 106 are described in detail in the following paragraphs.

Figure 2:
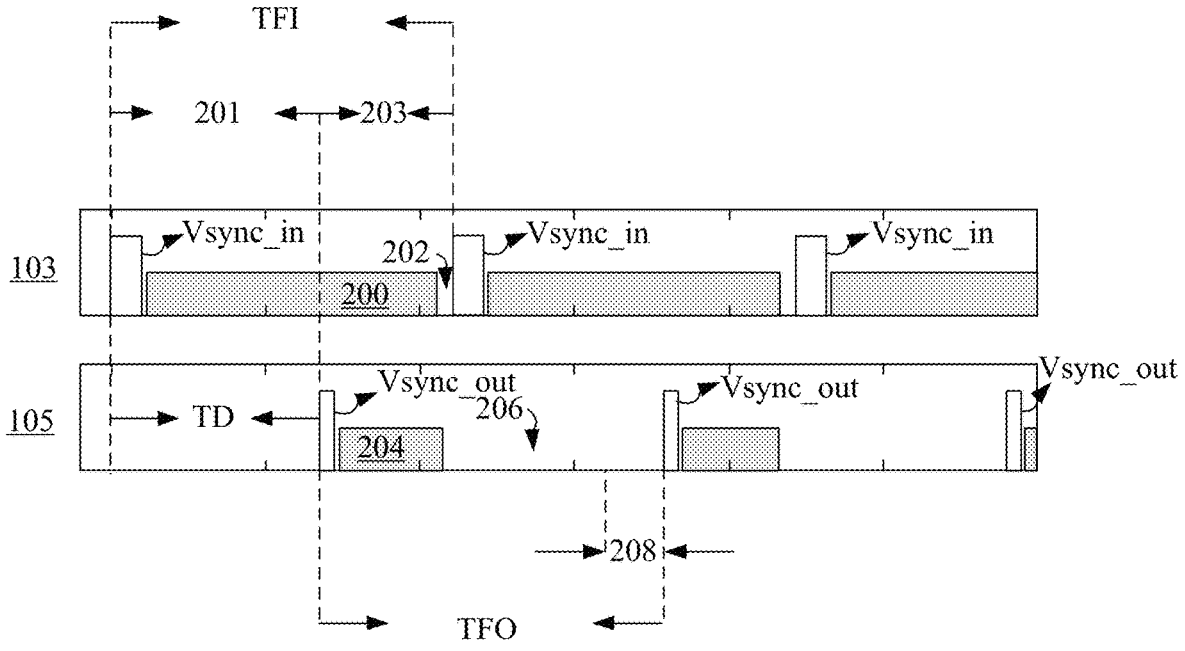
FIG. 2 is a timing diagram of the input display data and the output display data in an embodiment of the present invention.

Reference is now made to FIG. 2. FIG. 2 is a timing diagram of the input display data 103 and the output display data 105 in an embodiment of the present invention.

As illustrated in FIG. 2, the input display data 103 includes a plurality of input vertical sync signals Vsync_in. Each two of the neighboring input vertical sync signals Vsync_in has a corresponding data of a display frame.

In a frame time TFI between two neighboring input vertical sync signals Vsync_in, the input display data 103 includes an input frame data section 200 for performing data transmission according to an input pixel clock and an input blank section 202 after the input frame data section 200.

In an embodiment, the input frame data section 200 is used to transmit the actual frame data, and no frame data is transmitted during the input blank section 202. In an embodiment, the frame data is transmitted in the input frame data section 200 according to the input pixel clock. In a numerical example, the data amount of the frame data is 2000×1127 (the numbers respectively correspond to a vertical direction and a horizontal direction), in which the actual frame size is 1920×1080, and the frame refresh rate is 90 Hz. The input pixel clock is therefore 2000×1127×90=202.86 MHz. The length of the input blank section 202 is 0.46 milliseconds.

Similarly, the output display data 105 includes a plurality of output vertical sync signals Vsync_out. Each two of the neighboring output vertical sync signals Vsync_out has a corresponding data of a display frame. In the present embodiment, the length of the frame time TFO between two of the neighboring output vertical sync signals Vsync_out is the same as the length of the frame time TFI.

In the frame time TFO, the output display data 105 includes an output frame data section 204 for performing data transmission according to an output pixel clock rate which is higher than the input pixel clock rate. The output display data 105 further includes an output blank section 206 which is after the output frame data section 204.

Similarly, the output frame data section 204 is used to transmit the actual frame data, and no frame data is transmitted during the output blank section 206. Since the output pixel clock is larger than the input pixel clock, the data transmission for transmitting the amount of data corresponding to the input frame data section 200 can be performed in a shorter length of time during the output frame data section 204. On the contrary, the length of the output blank section 206 can be longer than the length of the input blank section 202.

In a numerical example, the output pixel clock is increased to 596.88 MHz. When the frame refresh rate is kept at 90 Hz, the data amount that can be transmitted becomes 2000×3316 (2000×3316×90=596.88 MHz). However, since the size of the frame is actually still 1920×1080, the length of the output frame data section 204 can be decreased to ⅓ of the length of the input frame data section 200. On the other hand, the length of the output blank section 206 can be increased to 7.49 milliseconds.

In an embodiment, in order not to lose the frame data, the frame time TFO of the output display data 105 is delayed for a predetermined time period TD relative to the frame time TFI of the input display data 103. In other words, the output vertical sync signals Vsync_out corresponding to each of the frame time TFO is delayed by the predetermined time period TD relative to the corresponding input vertical sync signals Vsync_in.

Under such a condition, the input frame data corresponding to the input frame data section 200 includes a first part 201 and a second part 203. The processing module 106 can store the first part 201 by using a storage unit 108 included therein such that within the output frame data section 204, the output frame data is generated by outputting the first part 201 by accessing the storage unit 108 and directly outputting the second part 203.

The processing module 106 is further configured to turn on the backlight module 104 after the liquid-crystal display panel 100 finished reacting to the output frame data corresponding to the output frame data section 204. In this embodiment, the backlight module 104 is turned on within the output blank section 206. In FIG. 2, the time period in which the backlight module 104 is turned on is illustrated as a section 208.

More specifically, by turning off the backlight module 104, an effect equivalent to an insertion of a black frame between the display frames can be accomplished by the display device 1. The insertion of the black frame by using the backlight module 104 decreases the time of the visual persistence of the human eyes to further reduce the effect of the motion blur. However, the reaction time of the liquid crystal of the liquid crystal display panel 100 is not fast enough. It takes 4-6 milliseconds or even above 10 milliseconds for the liquid crystal of the liquid crystal display panel 100 to finish reacting to the frame data. If the backlight module 104 is turned on too early, the reaction time of the display units of the liquid crystal display panel 100 which are refreshed in a later time period is not enough. The insufficient reaction time results in different degrees of improvement on the motion blur condition along the vertical direction of the display units.

As a result, by increasing the output pixel clock, the display device 1 in the present invention can transmit the frame data to the liquid crystal display panel 100 in a shorter time period such that the display units has a plenty of time to react. The backlight module 104 can be turned on in the section 208 after the liquid crystal display panel 100 finished reacting to the output frame data in the output frame data section 204. The issue of insufficient reaction time can be overcome.

It is appreciated that the length of the predetermined time TD for the delay and the size of the first part 201 which is required to be stored in the storage unit 108 can be determined according to the ratio between the output pixel clock and the input pixel clock and the reaction time of the liquid crystal display panel 100. Further, the backlight 101 generated by the backlight module 104 can be strobe backlight. The backlight module 104 determines the brightness of the light according to the length of time to be turned on. For example, when the length of time that the backlight module 104 is turned on is shorter, the brightness of the light can be increased to avoid the condition that the liquid crystal display panel 100 is too dark.

Figure 3:
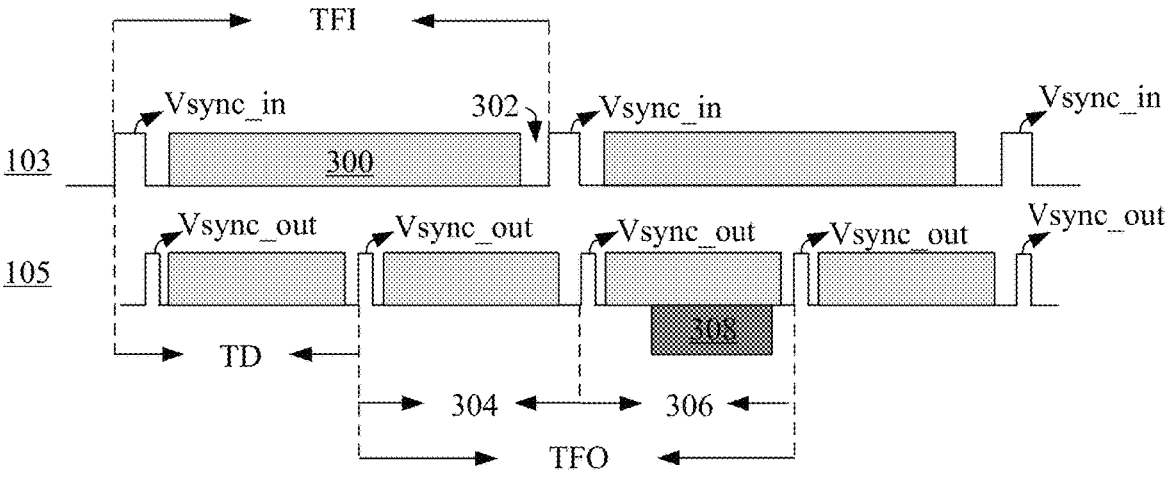
FIG. 3 is a timing diagram of the input display data and the output display data in an embodiment of the present invention.

Reference is now made to FIG. 3. FIG. 3 is a timing diagram of the input display data 103 and the output display data 105 in an embodiment of the present invention.

As illustrated in FIG. 3, the input display data 103 has a plurality of input vertical sync signals Vsync_in. Each two of the neighboring input vertical sync signals Vsync_in has a corresponding data of a display frame.

In a frame time TFI between two neighboring input vertical sync signals Vsync_in, the input display data 103 includes an input frame data section 300 for performing data transmission according to an input pixel clock and an input blank section 302 after the input frame data section 300.

In an embodiment, the input frame data section 300 is used to transmit the actual frame data, and no frame data is transmitted during the input blank section 302.

Similarly, the output display data 105 includes a plurality of output vertical sync signals Vsync_out. In the present embodiment, for the output display data 105, within the frame time TFO having the same length of time as the frame time TFI, two sub frame times are formed between every three output vertical sync signals Vsync_out. The first sub frame time is an output frame data section 304 and the second sub frame is a dummy output frame data section 306.

In another embodiment, the frame time of the output display data is separated by N output vertical sync signals Vsync_out to form N−1 sub frame times therebetween, in which N is an integer larger than 3. However, the present invention is not limited thereto. The output frame data section 304 corresponds to the first sub frame time, and the at least one sub frame time after the first frame time is the dummy output frame data section.

In an embodiment, in order not to lose the frame data, the frame time TFO of the output display data 105 is delayed for a predetermined time period TD relative to the frame time TFI of the input display data 103. In other words, the output vertical sync signals Vsync_out corresponding to each of the frame time TFO is delayed by the predetermined time period TD relative to the corresponding input vertical sync signals Vsync_in.

Under such a condition, the input frame data section 300 corresponds to the input frame data. The processing module 106 can store all the input frame data by using a storage unit 108 included therein such that within the output frame data section 304, the input frame data is outputted as the output frame data by partially accessing the data in the storage unit 108 and partially directly outputting the data according to the output pixel clock which is higher than the input pixel clock. Furthermore, the processing module 106 accesses the storage unit 108 during the dummy output frame data section 306 to perform data transmission again according to the output pixel clock which is higher than the input pixel clock. The input frame data is outputted again as dummy output frame data.

As a result, the processing module 106 is further configured to turn on the backlight module 104 within the dummy output frame data section 306 after the liquid-crystal display panel 100 finished reacting to the output frame data corresponding to the output frame data section 304. In FIG. 3, the time period in which the backlight module 104 is turned on is illustrated as a section 308.

More specifically, by turning off the backlight module 104, an effect equivalent to an insertion of a black frame between the display frames can be accomplished by the display device 1. The insertion of the black frame by using the backlight module 104 decreases the time of the visual persistence of the human eyes to further reduce the effect of the motion blur. However, the reaction time of the liquid crystal of the liquid crystal display panel 100 is not fast enough. It takes 4-6 milliseconds or even above 10 milliseconds for the liquid crystal of the liquid crystal display panel 100 to finish reacting to the frame data. If the backlight module 104 is turned on too early, the reaction time of the display units of the liquid crystal display panel 100 that are refreshed in a later time period is not enough. The insufficient reaction time results in different degrees of improvement on the motion blur condition along the vertical direction of the display units.

As a result, by increasing the output pixel clock, the display device 1 in the present invention can transmit the frame data to the liquid crystal display panel 100 in a shorter time period. The repetitive displaying of the frames makes the frame refresh rate of the output display data 105 becomes two times or an integer number of times (the integer is more than two) of the frame refresh rate of the input display data 103. However, the equivalent frame refresh rate of the output display data 105 is actually the same as the frame refresh rate of the input display data 103. Since the frame is displayed repetitively, the display units have a plenty of time to react. The backlight module 104 can be turned on in the section 308 after the liquid crystal display panel 100 finished reacting to the output frame data in the output frame data section 304, in which in an embodiment, the section 308 is the last repetitive frame. The issue of insufficient reaction time can be overcome.

It is appreciated that the length of the predetermined time TD for the delay can be determined according to the ratio between the output pixel clock and the input pixel clock and the reaction time of the liquid crystal display panel 100. Further, two times of the frame refresh rate of the output display data 105 is used as an example in the embodiment described above. In other embodiments, when the output pixel clock is even higher than the input pixel clock, the output frame data can be displayed in a higher rate.

Figure 4:
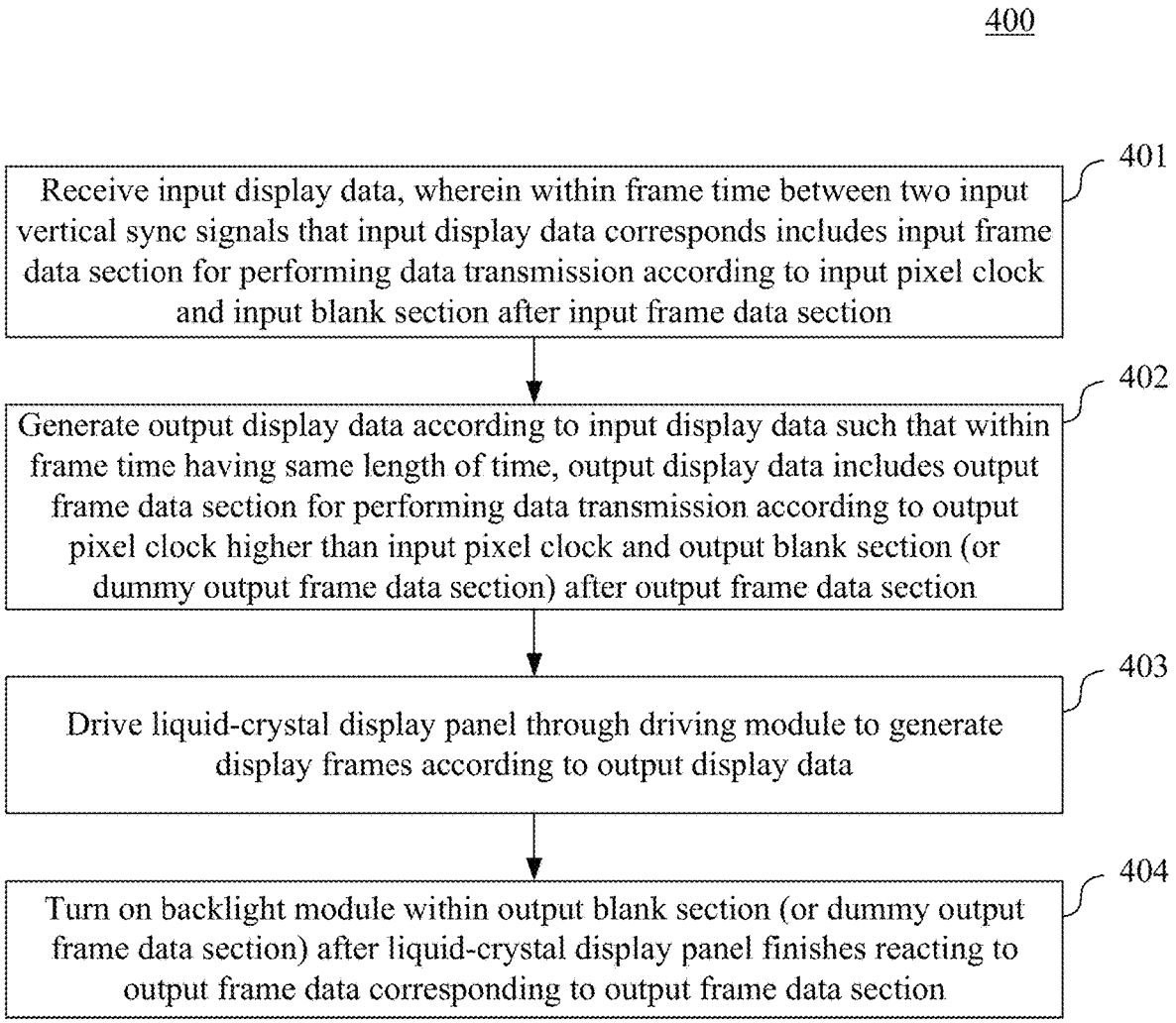
FIG. 4 is a display method for reducing the motion blur in an embodiment of the present invention.

Reference is now made to FIG. 4. FIG. 4 is a display method 400 for reducing the motion blur in an embodiment of the present invention. The display method 400 can be used in the display device 1 illustrated in FIG. 1. The display method 400 includes the steps outlined below (The steps are not recited in the sequence in which the steps are performed. That is, unless the sequence of the steps is expressly indicated, the sequence of the steps is interchangeable, and all or part of the steps may be simultaneously, partially simultaneously, or sequentially performed).

In step 401, the input display data 103 is received by the processing module 106, wherein within the frame time TFI between the two input vertical sync signals vsync_in that the input display data 103 corresponds includes an input frame data section 200 for performing data transmission according to an input pixel clock and an input blank section 202 after the input frame data section 200.

In step 402, the output display data 105 is generated by the processing module 106 according to the input display data 103 such that within the frame time TFO having the same length of time as the frame time TFI, the output display data 105 includes an output frame data section for performing data transmission according to an output pixel clock higher than the input pixel clock and an output blank section 206 or a dummy output frame data section 306 after the output frame data section 204.

In an embodiment, the processing module 106 generates the output frame data section 204 and the output blank section 206 in which no frame data is transmitted therein after the output frame data section 204, as illustrated in FIG. 2. In another embodiment, the processing module 106 generates the output frame data section 304 and the dummy output frame data section 306 that transmits the dummy frame data after the output frame data section 304, as illustrated in FIG. 3.

In step 403, the processing module 106 drives the liquid-crystal display panel 100 through the driving module 102 to generate the display frames according to the output display data 105.

In step 404, the processing module 106 turns on the backlight module 104 within the output blank section 206 or within the dummy output frame data section 306 after the liquid-crystal display panel 100 finished reacting to the output frame data corresponding to the output frame data section (the output frame data section 204 in FIG. 2 or the output frame data section 304 in FIG. 3).

Figure 5A:
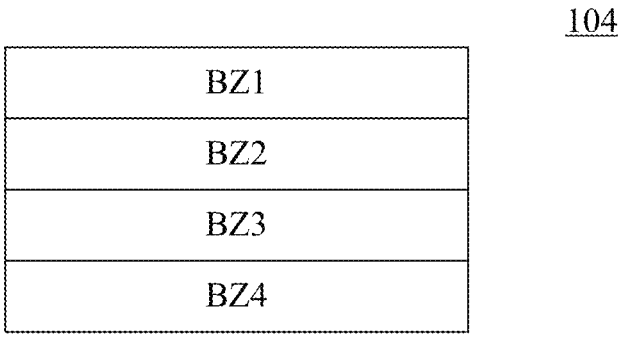
FIG. 5A is a diagram of the backlight module in an embodiment of the present invention.
Figure 5B:
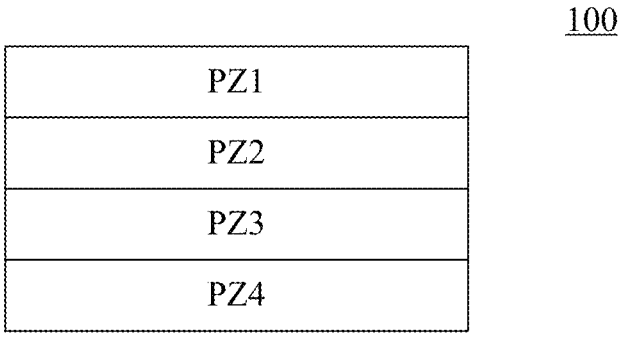
FIG. 5B is a diagram of the liquid crystal display panel in an embodiment of the present invention.
Figure 5C:
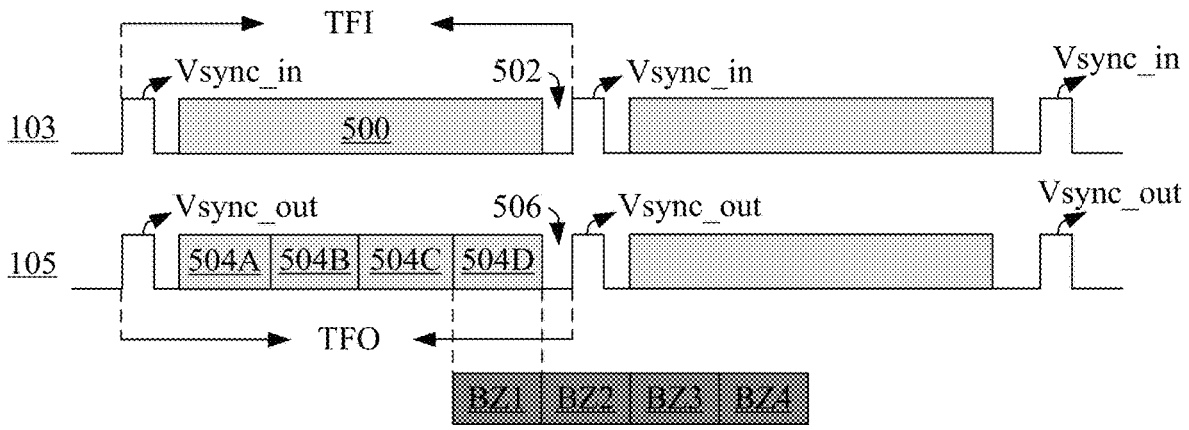
FIG. 5C is a timing diagram of the input display data, the output display data and the turn-on and turn-off of the backlight module in an embodiment of the present invention.

Reference is now made to FIG. 5A, FIG. 5B and FIG. 5C. FIG. 5A is a diagram of the backlight module 104 in an embodiment of the present invention. FIG. 5B is a diagram of the liquid crystal display panel 100 in an embodiment of the present invention. FIG. 5C is a timing diagram of the input display data 103, the output display data 105 and the turn-on and turn-off of the backlight module 104 in an embodiment of the present invention.

As illustrated in FIG. 5A and FIG. 5B, the backlight module 104 is divided into a plurality of backlight element zones BZ1, BZ2, BZ3 and BZ4. The liquid crystal display panel 100 is divided into a plurality of panel zones PZ1, PZ2, PZ3 and PZ4. The backlight elements can be light-emitting diodes or CCFLs and are divided into the backlight element zones BZ1, BZ2, BZ3 and BZ4. However, the present invention is not limited thereto. In an embodiment, the size of the liquid crystal display panel 100 is identical to the size of the backlight module 104. The backlight element zones BZ1, BZ2, BZ3 and BZ4 respectively generate backlight to the corresponding panel zones PZ1, PZ2, PZ3 and PZ4.

As illustrated in FIG. 5C, the input display data 103 has a plurality of input vertical sync signals vsync_in. Every two neighboring input vertical sync signals vsync_in includes data of a display frame therebetween.

Within the frame time TFI between the two neighboring input vertical sync signals vsync_in, the input display data 103 includes an input frame data section 500 for performing data transmission according to an input pixel clock and an input blank section 502 after the input frame data section 500.

In an embodiment, the input frame data section 500 is used to transmit the actual frame data, and no frame data is transmitted during the input blank section 502.

Similarly, within a frame time TFO between two neighboring output vertical sync signals vsync_out, the output display data 105 includes a plurality of output frame data sections 504A, 504B, 504C and 504D for performing data transmission according to an output pixel clock and an input blank section 506 after the output frame data sections 504A-504D.

In the present embodiment, the output pixel clock and the input pixel clock are the same. Further, no delay is required between the frame time TFO of the output display data 105 and the corresponding frame time TFI of the input display data 103. As a result, the total length of time of the output frame data sections 504A-5040 is the same as the input frame data section 500. The input frame data corresponding to the panel zones PZ1, PZ2, PZ3 and PZ4 is transmitted respectively in the output frame data sections 504A-504D. No frame data is transmitted in the input blank section 502.

The processing module 106 is configured to turn on the backlight element zones BZ1, BZ2, BZ3 and BZ4 respectively after the corresponding panel zones PZ1, PZ2, PZ3 and PZ4 finished reacting the output frame data to generate the backlight to the panel zones PZ1, PZ2, PZ3 and PZ4.

In FIG. 5C, the timing of the turn-on of the backlight element zones BZ1, BZ2, BZ3 and BZ4 are illustrated. In the present embodiment, the backlight element zone BZ1 is turned on during the time period corresponding to the output frame data section 504D to light up the panel zone PZ1.

As a result, for the panel zone PZ1, the display units therein have a reaction time equivalent to the length of the time of the frame data sections 504B and 504C. When the subsequent backlight element zones BZ2-BZ3 are turned on to light up the panel zones PZ2-PZ3, the display units within these zones also have the same amount of reaction time.

In an embodiment, the length of time that the backlight element zones BZ1, BZ2, BZ3 and BZ4 are turned on is equivalent to the length of time of the output frame data sections 504A-504D such that the panel zones PZ2-PZ3 have an even reaction time and even brightness.

As a result, the display device 1 can turn on the backlight module 104 zone by zone without modifying the pixel clock and the refresh rate of the output display data 105 relative to the input display data 103. The display units can have enough reaction time. The issue of insufficient reaction time of the liquid display panel 100 can be overcome.

Figure 6:
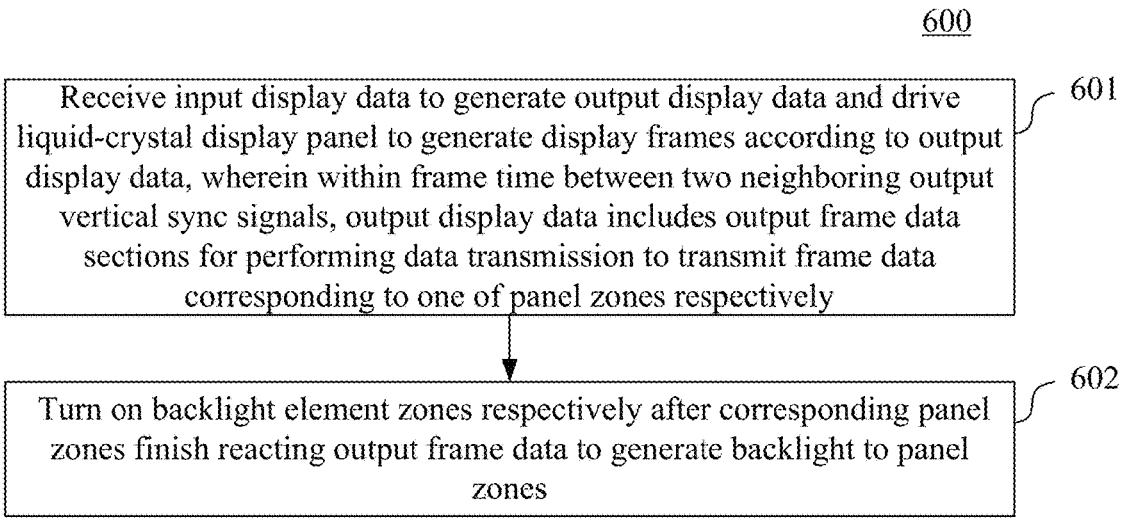
FIG. 6 is a display method for reducing the motion blur in an embodiment of the present invention.

Reference is now made to FIG. 6. FIG. 6 is a display method 600 for reducing the motion blur in an embodiment of the present invention. The display method 600 can be used in the display device 1 illustrated in FIG. 1 and FIG. 5A, FIG. 5B and FIG. 5C. The display method 600 includes the steps outlined below (The steps are not recited in the sequence in which the steps are performed. That is, unless the sequence of the steps is expressly indicated, the sequence of the steps is interchangeable, and all or part of the steps may be simultaneously, partially simultaneously, or sequentially performed).

In step 601, the input display data 103 is received by the processing module 106 to generate output display data 105 and drive the liquid-crystal display panel 100 through the driving module 102 to generate the display frames according to the output display data 105. Within a frame time TFO between two neighboring output vertical sync signals vsync_out, the output display data 105 includes a plurality of output frame data sections 504A, 504B, 504C and 504D for performing data transmission to transmit the frame data corresponding to one of the panel zones respectively.

In step 602, the processing module 106 turns on the backlight element zones BZ1, BZ2, BZ3 and BZ4 respectively after the corresponding panel zones PZ1, PZ2, PZ3 and PZ4 finished reacting the output frame data to generate the backlight to the panel zones PZ1, PZ2, PZ3 and PZ4.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A display device for motion blur reduction comprising:

a liquid-crystal display panel;

a driving module electrically coupled to the liquid-crystal display panel;

a backlight module configured to generate a backlight to the liquid-crystal display panel; and a processing module electrically coupled to the backlight module and the driving module and configured to receive input display data, wherein the input display data corresponds to a frame time between two neighboring input vertical sync signals (Vsync), and the frame time comprises an input frame data section for performing data transmission according to an input pixel clock and an input blank section after the input frame data section;

wherein the processing module is configured to generate output display data according to the input display data such that within the frame time having the same length, the output display data comprises an output frame data section for performing data transmission with an output pixel clock higher than the input pixel clock and a dummy output frame data section after the output frame data section, and the processing module is configured to drive the liquid-crystal display panel through the driving module to generate a display frame according to the output display data;

the processing module is further configured to turn on the backlight module within the dummy output frame data section after the liquid-crystal display panel finished reacting to output frame data corresponding to the output frame data section, wherein the output frame data outputted by the processing module within the output frame data section is the same as a dummy output frame data outputted within the dummy output frame data section.

2. The display device of claim 1, wherein the frame time of the output display data is delayed for a predetermined time period relative to the frame time of the input display data.

3. The display device of claim 2, wherein the frame time of the output display data is separated by N output vertical sync signals to form N−1 sub frame times therebetween, a first sub frame time is the output frame data section and the at least one sub frame after the first sub frame time is the dummy output frame data section;

wherein the input frame data section corresponds to input frame data, and the processing module further comprises a storage unit configured to store the input frame data such that the input frame data is outputted as the output frame data in the output frame data section, and the input frame data is accessed from the storage unit to be outputted again as dummy output frame data in each of the sub frame time after the first sub frame time.

4. The display device of claim 3, wherein a frame refresh rate of the output display data is 2 times or an integer number of times that is larger than 2 of the frame refresh rate of the input display data.

5. The display device of claim 1, wherein the processing module is a scaler or a timing controller.

6. A display method for motion blur reduction used in a display device which comprises a liquid crystal display panel, a driving module electrically coupled to the liquid-crystal display panel, a backlight module configured to generate a backlight to the liquid-crystal display panel and a processing module electrically coupled to the backlight module and the driving module, the display method comprises:

receiving input display data by the processing module, wherein the input display data corresponds to a frame time between two neighboring input vertical sync signals, and the frame time comprises an input frame data section for performing data transmission according to an input pixel clock and an input blank section after the input frame data section;

generating output display data according to the input display data by the processing module such that within the frame time having the same length, the output display data comprises an output frame data section for performing data transmission with an output pixel clock higher than the input pixel clock and a dummy output frame data section after the output frame data section;

driving the liquid-crystal display panel through the driving module by the processing module to generate a display frame according to the output display data; and turning on the backlight module by the processing module within the dummy output frame data section after the liquid-crystal display panel finished reacting to output frame data corresponding to the output frame data section, wherein the output frame data outputted by the processing module within the output frame data section is the same as a dummy output frame data outputted within the dummy output frame data section.

7. The display method of claim 6, wherein the frame time of the output display data is delayed for a predetermined time period relative to the frame time of the input display data.

8. The display method of claim 7, wherein the frame time of the output display data is separated by N output vertical sync signals to form N−1 sub frame times therebetween, a first sub frame time is the output frame data section and the at least one sub frame after the first sub frame time is the dummy output frame data section and the input frame data section corresponds to input frame data, and the display method further comprises:

storing the input frame data by a storage unit comprised by the processing module;

outputting the input frame data as the output frame data in the output frame data section; and accessing the input frame data from the storage unit to output the input frame data again as the dummy output frame data in each of the sub frame time after the first sub frame time.

9. The display method of claim 8, wherein a frame refresh rate of the output display data is 2 times or an integer number of times that is larger than 2 of the frame refresh rate of the input display data.

10. The display method of claim 6, wherein the processing module is a scaler or a timing controller.

* * * * *